US009322174B1

(12) United States Patent
Williams et al.

(10) Patent No.: US 9,322,174 B1
(45) Date of Patent: Apr. 26, 2016

(54) ROOFING TILE FASTENER AND LOCKING SYSTEM

(71) Applicants: John M. Williams, Wells, VT (US); Robert B. Williams, Poultney, VT (US)

(72) Inventors: John M. Williams, Wells, VT (US); Robert B. Williams, Poultney, VT (US)

( * ) Notice: Subject to any disclaimer, the term of this patent is extended or adjusted under 35 U.S.C. 154(b) by 0 days.

(21) Appl. No.: 14/620,808

(22) Filed: Feb. 12, 2015

(51) Int. Cl.
*E04D 1/34* (2006.01)
*E04D 1/12* (2006.01)

(52) U.S. Cl.
CPC .. *E04D 1/34* (2013.01); *E04D 1/12* (2013.01); *E04D 2001/345* (2013.01); *E04D 2001/3411* (2013.01); *E04D 2001/3458* (2013.01); *E04D 2001/3494* (2013.01)

(58) Field of Classification Search
CPC ..... E04D 1/34; E04D 1/12; E04D 2001/3458; E04D 2001/345; E04D 2001/3494; E04D 2001/3411
See application file for complete search history.

(56) References Cited

U.S. PATENT DOCUMENTS 876,579 A * 1/1908 Esselen ..... A47J 37/0694 126/30
1,126,823 A * 2/1915 Milmoe ..... A23G 4/20 206/800
1,574,098 A * 2/1926 Kridler ..... E04D 1/26 52/547
1,579,715 A * 4/1926 Boyle ..... E04D 1/34 403/408.1
1,613,156 A * 1/1927 Bergner ..... E04D 1/34 52/548
1,790,860 A * 2/1931 Harvey ..... E04D 1/34 52/547
1,814,405 A * 7/1931 Myhre ..... E04D 1/34 52/547
1,978,190 A * 10/1934 Figge ..... E04D 1/34 52/543
1,987,133 A * 1/1935 Smith ..... E04D 1/34 411/458
2,100,254 A * 11/1937 Kridler ..... E04D 1/34 229/5.7
2,227,939 A * 1/1941 Kridler ..... E04D 1/34 52/547
2,475,795 A * 7/1949 Lockwood ..... E04D 1/34 52/547
2,517,122 A * 8/1950 Lockwood ..... E04D 1/34 52/547
2,588,673 A * 3/1952 Tyson ..... E04D 1/34 52/546
4,422,278 A * 12/1983 Fujihiro ..... E04D 12/004 52/478
4,958,471 A * 9/1990 Waddington ..... E04D 1/34 52/546
5,079,889 A * 1/1992 Wright ..... E04D 1/34 52/541
5,577,360 A * 11/1996 Gibbs ..... E04D 1/34 52/518

(Continued)

*Primary Examiner* — Brian Glessner
*Assistant Examiner* — Gisele Ford
(74) *Attorney, Agent, or Firm* — Lawrence J. Shurupoff

(57) ABSTRACT

A cantilevered leaf spring is biased against the upper edge of a roofing tile to prevent the tile from sliding upward beneath an overlying upper row of roofing tiles. The leaf spring can be formed as a part of a tile fastener which includes a hooked portion for receiving and holding the lower edge of a roofing tile on a roof. A series of tile fasteners is mounted to a layer of roofing material to facilitate installation of tiles without the need for installation tools. Damaged tiles can be easily replaced without the need for installation or removal tools. With this system, each row of underlying tiles is locked in place by the combined effect of an overlying and overlapping row of tiles and a spring awl on an upper fastener pushing the upper edge of a tile downwardly so that the lower edge of the tile is forced into the mouth of a lower fastener.

20 Claims, 7 Drawing Sheets

(56) References Cited

U.S. PATENT DOCUMENTS 5,617,690 A * 4/1997 Gibbs ..... E04D 1/34 52/518
5,642,596 A * 7/1997 Waddington ..... E04D 1/34 52/546
5,791,112 A * 8/1998 Plum ..... E04D 1/34 52/543
5,794,396 A * 8/1998 Gibbs ..... E04D 1/16 52/518
5,921,045 A * 7/1999 Hickey ..... E04D 1/045 52/543
6,052,961 A * 4/2000 Gibbs ..... E04D 1/16 52/518
7,444,790 B2 * 11/2008 Hick ..... E04D 1/34 52/546
7,448,177 B2 * 11/2008 McClintick ..... E04D 1/14 52/551
7,478,507 B2 * 1/2009 Krause ..... E04F 13/0832 52/546
7,530,207 B2 * 5/2009 Morrill ..... E04D 13/1625 52/746.11
9,097,021 B1 * 8/2015 Williams ..... E04D 1/365
2006/0080942 A1 * 4/2006 O'Neill ..... E04D 1/16 52/790.1
2007/0151171 A1 * 7/2007 McClintick ..... E04D 1/14 52/87
2008/0196346 A1 * 8/2008 Gibbs ..... E04D 1/34 52/543
2008/0236087 A1 * 10/2008 Hick ..... E04D 1/34 52/546
2009/0272062 A1 * 11/2009 Gibbs ..... E04D 1/34 52/543
2011/0225904 A1 * 9/2011 Railkar ..... E04D 12/004 52/173.3
2012/0055111 A1 * 3/2012 Fernandez Fernandez ..... E04D 1/14 52/543
2012/0304578 A1 * 12/2012 Williams ..... E04D 1/34 52/520
2013/0160388 A1 * 6/2013 Williams ..... E04D 1/34 52/551
2013/0180201 A1 * 7/2013 Williams ..... E04D 1/34 52/698
2013/0247496 A1 * 9/2013 Fernandez Fernandez ..... E04B 1/762 52/543
2014/0250815 A1 * 9/2014 Vander Laan et al. .. E04D 1/265 52/520

* cited by examiner

ROOFING TILE FASTENER AND LOCKING SYSTEM

BACKGROUND AND SUMMARY

Roofing tiles, such as slate and ceramic tiles, are typically installed by skilled roofers using roofing nails. This requires a "feel" for driving the nails with the proper force. Too much force can result in cracked or broken tiles and too little force results in loose tiles which can be damaged or lost in high winds.

In order to simplify the installation of roofing tiles, specialized tile hooks have been developed to hold tiles on a roof without directly nailing the tiles to a roof. While these specialized fasteners work well in low wind conditions, it has been found that in high wind conditions, the fastener hooks can bend and release a tile from the roof or allow a tile to slide upwardly beneath an upper row of tiles.

This disclosure is directed to a hook type fastener for fastening and holding tiles to a roof even in high wind conditions. In one embodiment, a spring arm is provided on each fastener for preventing a tile from being blown upwardly under overlying tiles and out of its fastener hook. Other advantages are realized with a multifunction fastener as described herein including both functional and aesthetic benefits.

For example, when using the fasteners described herein, adjacent tiles can be spaced apart by about 3/16 inch (0.187 inch) when installed with a fastener projecting upwardly between them. This spacing creates an opening or channel between adjacent tiles allowing rain and melting ice and snow to easily flow downwardly through the channels and away from the roof. Without this relatively wide spacing between tiles, water will typically seep into the cracks between adjacent abutting tiles and travel in all directions beneath the tiles by capillary action. This seepage eventually reaches the roof deck thereby causing water damage.

Another advantage to the relatively wide spacing between tiles is the visual effect created by the separated tiles. The spacing creates a pleasing deep shadow line making the tiles appear deeper and thicker as opposed to the tapered abutting edges of conventional tile roofs.

In one embodiment, a tile fastener is provided with a pair of laterally extending side wings or anchors which receive the weight of a pair of overlying tiles and thereby hold the fastener on the roof under the weight of the overlying tiles. In another embodiment, a modified tile hook is provided with a laterally extending arm that engages the upper edge of one adjacent tile, and in yet another embodiment, a pair of laterally extending arms engages the upper edges of two adjacent tiles to lock the tiles in position on a roof. The anus can be formed as cantilevered leaf springs.

Once a first row or course of tiles is installed, a second row or course of tiles is installed over the first row or course with a partial overlap. Tiles on the second course are inserted into the open mouths of fastener hooks projecting vertically upwardly from gaps between adjacent tiles on the first course and, as explained further below, tiles on the second course bear down on, hold down and secure in place the tiles in the first course.

This arrangement provides a semi-permanent roofing tile construction wherein underlying tiles are effectively locked in position by the combined action of a spring arm, the weight of a course of overlying tiles and the retention of the overlying tiles within a series of hooks provided along the underlying course of tiles.

The fastener hooks in a first course of tiles are anchored in place beneath the first row or course of tiles in a manner which prevents the mouths of the fasteners from lifting upwardly, bending open and releasing a tile.

An advantage of the roofing system disclosed herein is the ease of quickly installing a new tile roof and quickly and easily manually replacing broken or damaged tiles without the need for tools. That is, once a layer or strip of roofing material having a series of hooked fasteners preassembled on, coupled to or otherwise attached to the roofing material is secured to a roof deck, an installer need only slide a roofing tile upwardly and over a fastener hook on a lower fastener with the upper edge of the tile pushing against the bias of a fastener spring arm on an upper fastener and then release the bottom edge of the tile into the mouth of the fastener hook on the lower fastener. No tools are needed for this installation or for subsequent tile replacement.

Once so installed, a tile can be easily removed and replaced without tools and without any special skill or "feel" by pushing up against the bottom edge of the tile and sliding the tile upwardly along the plane of the roof and against the bias of the spring arm. Once the bottom edge of the tile clears the mouth of the fastener hook, the tile can be easily pulled downwardly from under the overlying row of tiles and lifted up and off of the roof. A new or replacement tile can then simply slide in place under the upper row of tiles as described above.

DETAILED DESCRIPTION OF REPRESENTATIVE EMBODIMENTS

Figure 1:
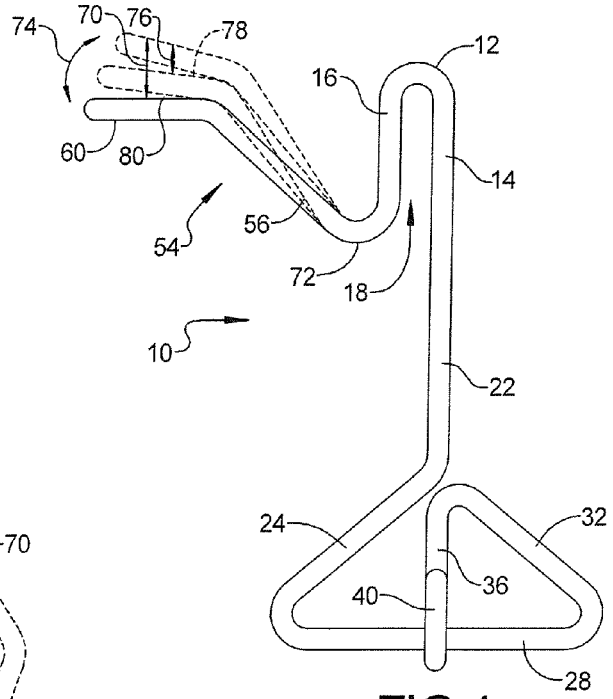
FIG. 1 is a top plan view of a tile fastener constructed in accordance with a first embodiment of this disclosure.

As shown in FIGS. 1 to 4, a fastener 10 is constructed for use in mounting tiles to a substrate, such as mounting roofing tiles to a roof. As used herein, the term tile or tiles includes any type of natural or synthetic substantially rigid tile or shingle. In particular, natural slate and stone tiles and ceramic tiles fall under the general terms "tile or tiles."

The fastener 10 can be formed of a wire such as steel, copper, aluminum and alloys thereof. Stainless steel wire performs well. It is also possible to form the fastener 10 of flexible plastic.

As further seen in FIGS. 1-4, the fastener 10 includes an arched top portion 12 having a pair of substantially parallel legs 14, 16 defining a mounting portion 18. Leg 14 extends downwardly into a first shank portion 22 which extends further downwardly into a first laterally outwardly and downwardly extending first wing portion 24. Wing portion 24 bends back inwardly into a base leg 28 which extends under and beyond the shank portion 22 and then bends upwardly and inwardly toward the shank portion 22 thereby forming a second wing portion 32.

Figure 3:
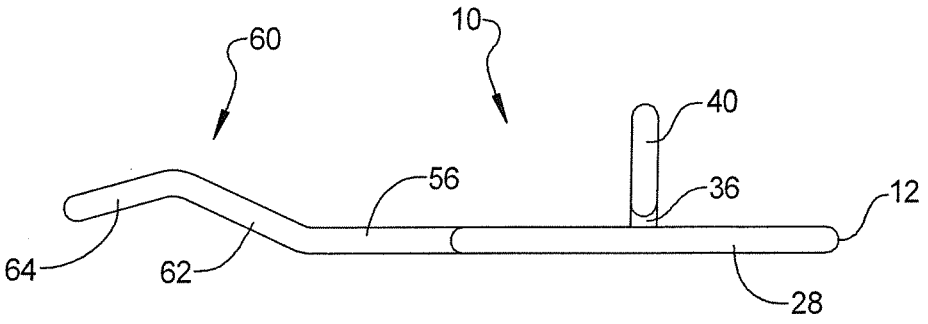
FIG. 3 is a bottom elevation view of the fastener of FIG. 1.
Figure 4:
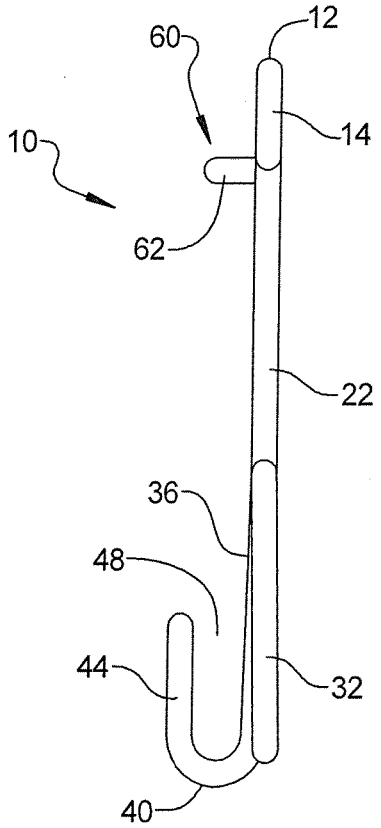
FIG. 4 is a right side elevation view of FIG. 2.

The top of the second wing portion 32 bends downwardly below the first shank portion 22 to form a second shank portion 36 extending into a hook portion 40. As seen in FIGS. 3 and 4, the hook portion 40 bends upwardly above the plane of the first and second wing portions 24, 32 and into a free end hook portion 44. The free end hook portion 44 extends over the second shank portion 36 to define an open mouth 48 for removably receiving a tile.

As further seen in FIGS. 1-4, one leg 16 of the mounting portion 18 extends laterally into a cantilevered spring arm 54 having an upwardly and laterally extending inner lower portion 56 and an outer laterally and upwardly extending free end tile engagement portion 60. The free end tile engagement portion 60 can arch vertically up above the substantially common plane of the mounting portion 18, the first and second shank portions 22, 36, the first and second wing portions 24, 32 and the inner lower portion of the spring arm 54. This is best seen in FIGS. 3 and 4.

In the embodiment of FIGS. 1-4, the free end tile engagement portion 60 includes an upwardly extending inner portion 62 and a downwardly extending tip portion 64. The free end portion 60 is dimensioned to resiliently engage the top edge of a tile and maintain a predetermined spring biased downward retaining force against the tile, as will be explained in more detail below. In general, the spring arm 54 is designed to resiliently flex over a distance 70 (FIGS. 1 and 2) by pivoting about a pivot portion 72 over an arc 74. Pivot portion 72 is formed as an elbow or bend between the leg 16 on the mounting portion 12 and the inner lower portion 56 of the spring arm 54.

Figure 2:
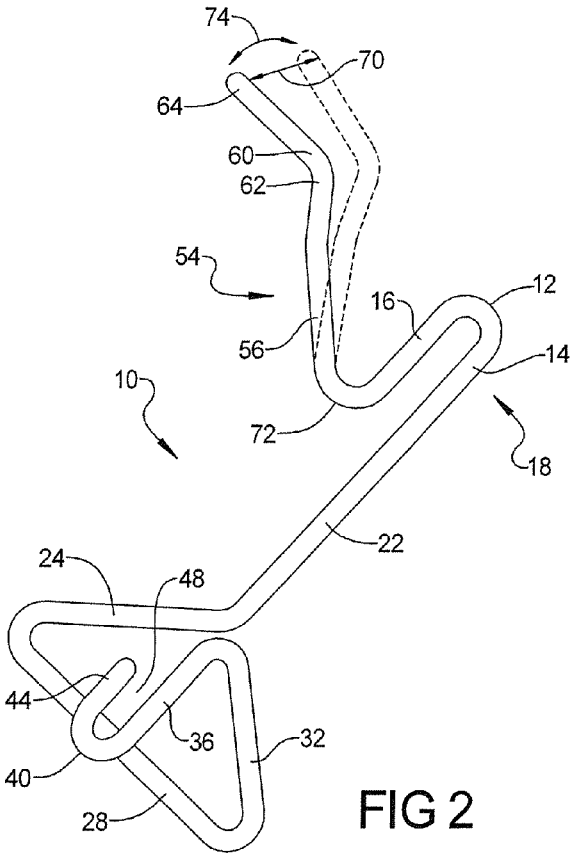
FIG. 2 is a top perspective view of the fastener of FIG. 1.
Figure 7:
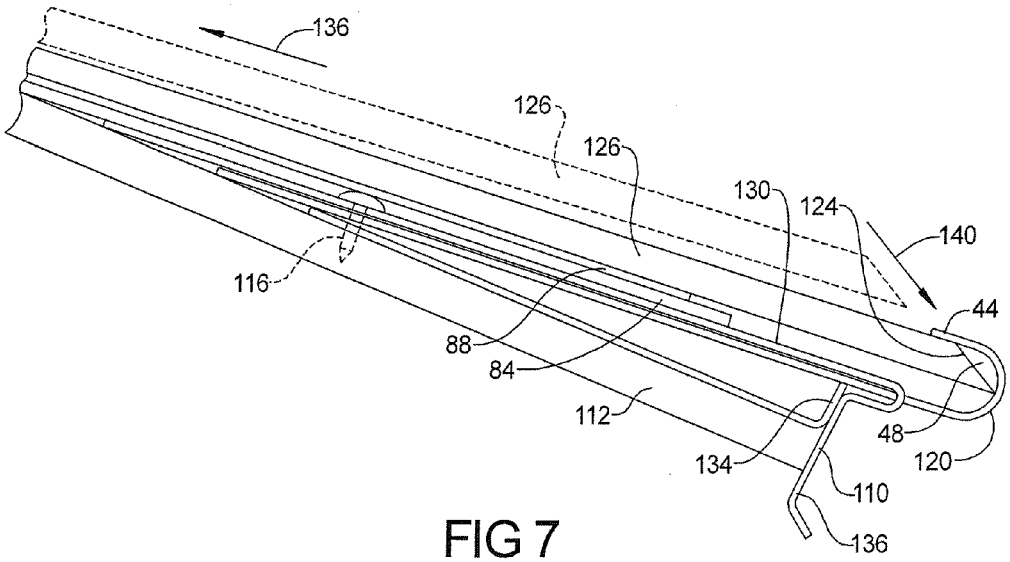
FIG. 7 is a partial side elevation view of the tile installation assembly of FIG. 5 installed on the drip edge assembly of FIG. 6 and schematically depicting the installation of a tile over the tile installation assembly and into the hooks on the drip edge assembly.

As represented in FIGS. 1, 2 and 7, when a tile is installed in position on a roof deck, its upper edge slides up along the roof deck and contacts, abuts and displaces the free end tile engagement portion 60 of a fastener spring arm 54 located in an upper row of fasteners. This causes the spring arm 54 to flex from its at rest or unstressed position as shown in solid lines in FIGS. 1 and 2, over a distance 70 of, for example, one half inch. This is required to allow the lower edge of the tile to move over and above the free end hook portion 44 of a hook 40 on a fastener located in a lower row of fasteners.

Once the tile clears the free end hook portion 44 on a fastener in the lower row of fasteners, the tile is then released downwardly along the roof deck under the spring force of spring arm 54 and inserted downwardly toward the roof deck and into the open mouth 48 of the hook portion 40. This insertion allows the spring arm 54 to partially return to its at rest position at an intermediate position 78 (FIG. 1) between a fully upwardly deflected temporary installation position and the initial at rest position, thereby maintaining a biased spring arm displacement 80 and a downward biasing force against a tile. Displacement 80 can be, for example, about one fourth of an inch from its initial unstressed position.

That is, when a tile is installed, it is dimensioned for proper mounting between an upper fastener 10 and a lower fastener 10. The bottom edge to top edge dimension of the tile is chosen so that the bottom edge of the tile must move over and clear the top of the free end hook portion 44 of the hook portion 40 on a lower row of fasteners 10, while the upper edge of the tile engages and pushes upwardly the free end tile engagement portion 60 on a fastener 10 in an upper row of fasteners. An installer pushes the tile upwardly until its lower edge clears the free end hook portion 44 of the lower fastener and then lowers the lower edge of the tile into a seated and secure spring biased position within the open mouth 48 of the hook portion 40.

As the lower edge of a tile is seated into the hook portion 40, the upper edge of the tile partially retracts a distance 76 of, for example, about one fourth inch, thereby maintaining a constant spring biasing force against the top edge of a tile. This force provides a positive seating force between the lower edge of the tile and the mouth 48 of the hook portion 40.

Stated another way, the distance between the open mouth 48 of the hook portion 40 on a lower fastener 10 and the tile engagement portion 60 of the spring arm 54 on an upper fastener 10 is less than the distance between the top and bottom edges of a tile, thereby necessitating the upward deflection of the spring arm 54 in order to allow insertion of the bottom edge of the tile into the open mouth 48 of the hook portion 40.

Figure 5:
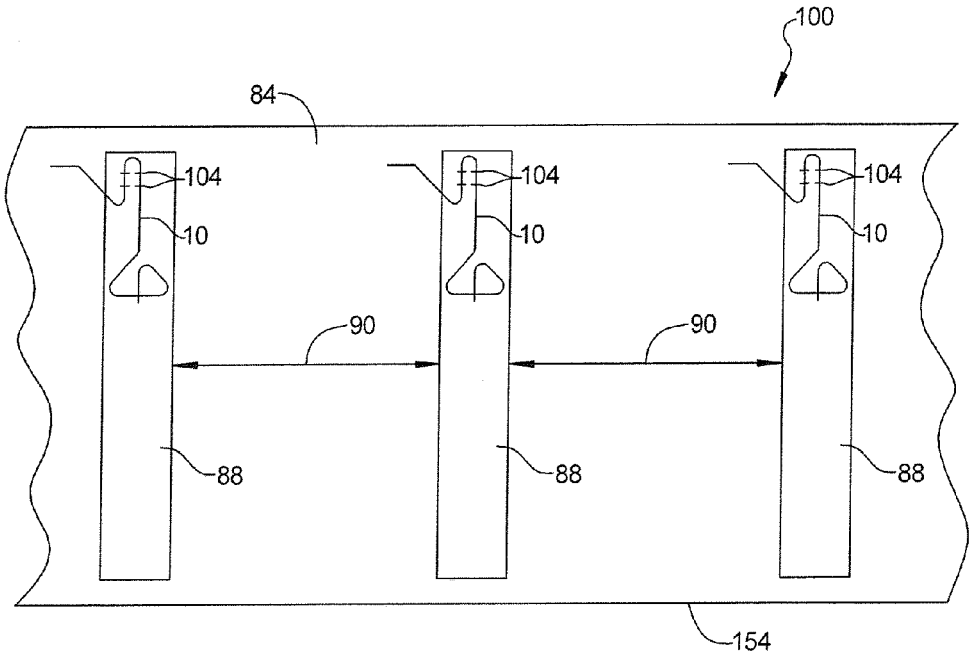
FIG. 5 is top plan view of a tile installation assembly having a series of the fasteners of FIG. 1 attached to a bottom layer of roofing material and to a series of overlying weather barrier strips.

In order to achieve the secure biased tile installation described above, a series of fasteners 10 is mounted to a sheet of roofing material 84 as shown in FIG. 5. Roofing material 84 can be any suitable water resistant or weather resistant material such as plastic materials, fabric or fiber materials. High density polyethylene (HDPE) has been found to function well, as does ninety weight roofing material known in the trade as "tar paper." Suitable thicknesses for these flexible sheet materials are known in the trade. For example 0.020 inch thick HDPE has been found to perform well.

As further shown in FIG. 5, a series of weather shields 88 is mounted over the roofing material 84 at predetermined equal spacings 90 slightly narrower than the width of the tiles mounted over the roofing material 84 and weather shields 88. HDPE provides a smooth low friction durable surface over which roofing tiles may be safely and easily installed with a smooth sliding fit. The weather shields 88 may be cut or formed from the same material as the roofing material 84, with HDPE serving well. While it is preferred to include the weather shields 88 on the tile installation assembly 100, in some cases, the weather shields may be omitted and the fasteners 10 then being directly secured on and in direct contact with the roofing material 84.

Figure 10:
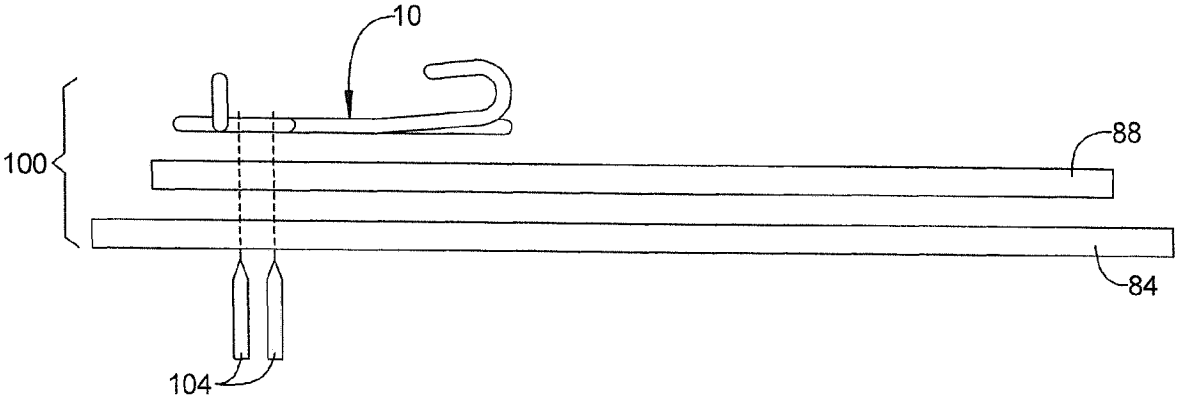
FIG. 10 is an exploded side elevation view of the tile installation assembly of FIG. 5.

FIG. 5 further shows a series of fasteners 10 mounted in predetermined equally spaced apart positions over the upper central portion of each weather shield 88. As seen in FIG. 10, one or more mechanical fasteners, such as a pair of staples 104, can be used to clamp and fix together as an integral tile installation assembly 100 the roofing material 84, the weather shields 88 and the fasteners 10.

Figure 6:
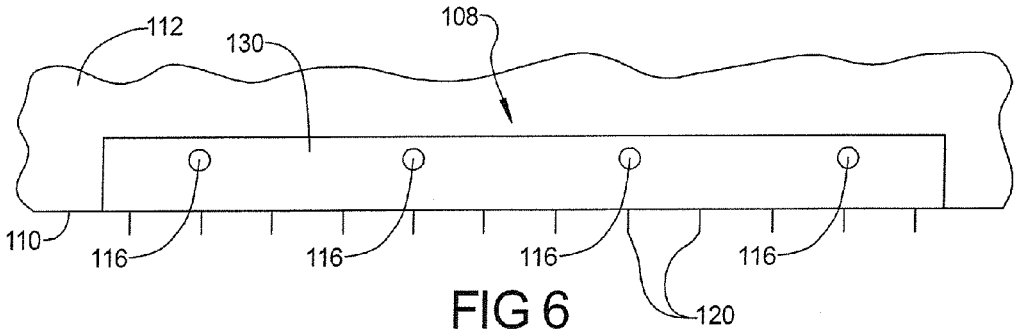
FIG. 6 is a top plan view of a drip edge assembly mounted along the lower edge or eave of a roof.
Figure 8:
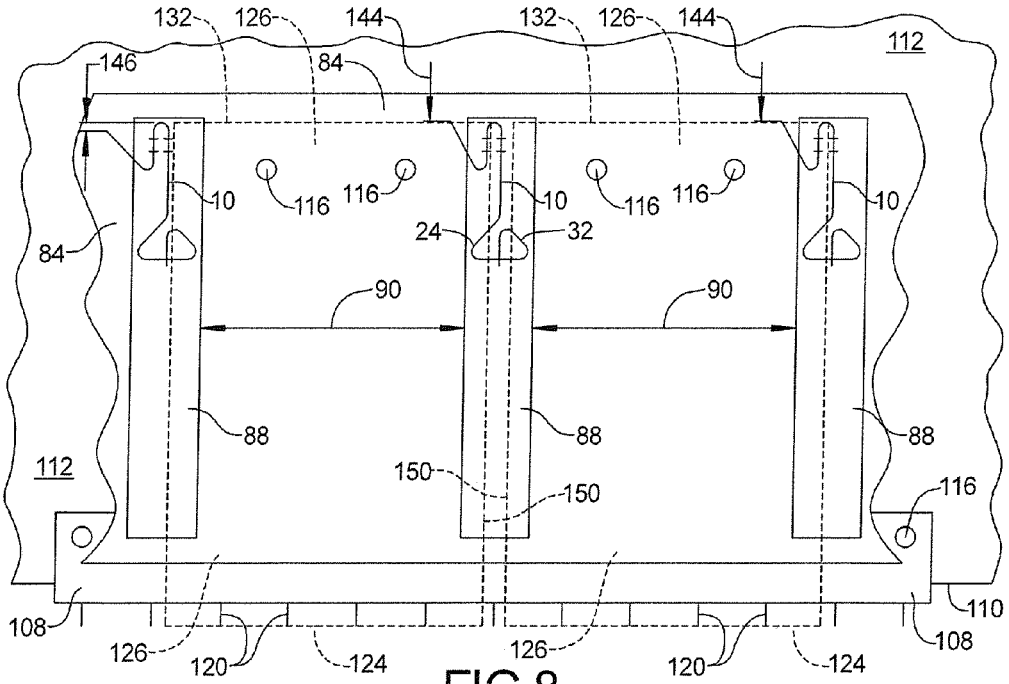
FIG. 8 is a top plan view of FIG. 7 showing a pair of installed tiles in phantom for clarity.
Figure 9:
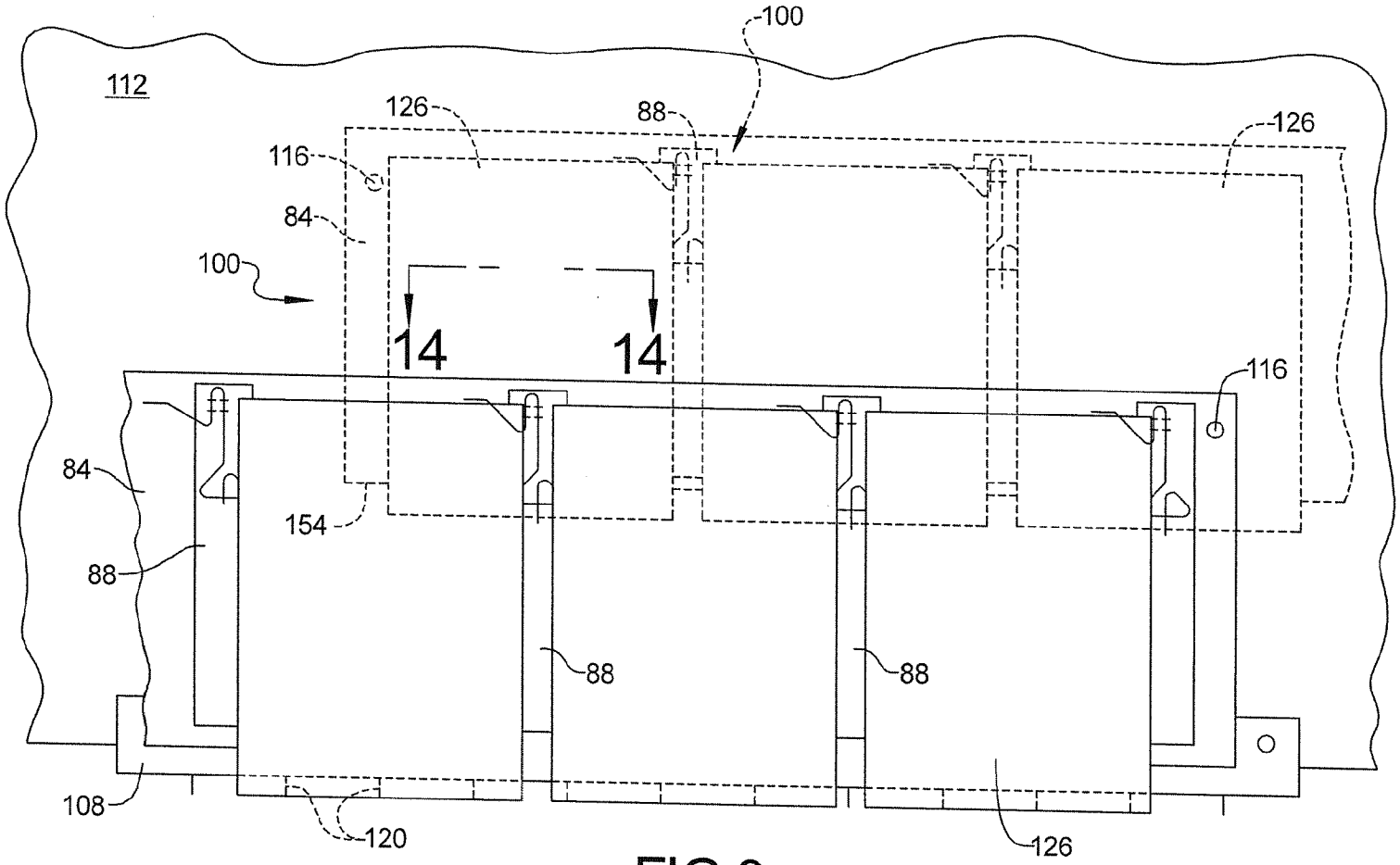
FIG. 9 is a top plan view of a first row of tiles installed as shown in FIG. 8 and a second row of tiles shown in phantom for clarity and installed over the first row of tiles.

To begin installation of a tile roof using a bottom-to-top (eave-to-ridge) assembly method, a drip edge assembly 108 such as shown in FIGS. 6 and 7 is attached along the bottom edge or eave 110 of a typical wooden roof deck 112. Roofing nails 116 are typically used for this purpose. The drip edge 108 can include a series of hooks 120 for receiving the bottom edges 124 of a first row of tiles 126 (FIGS. 7-9). It should be noted that the tile installation assembly 100 can also be used with a top-to-bottom (ridge-to-eave) assembly method without the need for specialized tools typically needed for this alternate installation method.

The drip edge assembly 108 is typically formed of a thin sheet of copper or other suitable metal. The top surface 130 is raised over eave 110 of the roof deck 112 by a lift arm 134. A front wall 136 protects the eave 110 from rain, snow, wind and harsh environments.

Once the drip edge assembly 108 is installed on the roof deck 112, the tile installation assembly 100 is aligned over the drip edge assembly such as shown in FIGS. 7 and 8, and fastened to the roof deck with roofing nails 116, staples or any other suitable means. In the example of FIGS. 5-9, roofing nails 116 are used for mounting the tile installation assembly 100 over the roof deck 112 and over the drip edge assembly 108 as further shown in FIG. 8.

As further shown in dashed lines or phantom view in FIG. 8, a first row of tiles 126 is quickly and easily manually installed on the tile installation assembly 100 without the need for installation tools, nails or any other fasteners. With reference to both FIGS. 7 and 8, an installer initially centers a tile 126 between a pair of adjacent fasteners 10 by sliding the tile upwardly over the smooth surfaces of the weather shields 88 and over leg 16 and inner lower portion 56 of a fastener 10 until the upper edge 132 of the tile 126 engages the raised or upwardly extending free end portion 60 of the spring arm 54.

At this point, the lower edge 124 of the tile 126 overlies and extends below the free end portion 44 of the hook portion 40 and cannot be inserted within the open mouth 48. An installer simply pushes the tile against the free end tile engagement portion 60 of the spring arm 54 to deflect it upwardly over the roof deck over a distance 70 as shown in FIGS. 1 and 2. This position of the tile is shown in phantom in FIG. 7 where directional arrow 136 denotes the upward push by an installer against the spring arm 54 to position the lower edge 124 of the tile 126 above and clear of the free end portion 44 of the hook portion 40.

An installer can now easily drop down and release the lower edge 124 of the tile 126 into the open mouth 48 of the book portion 40 as shown by directional arrow 140 in FIG. 7. This results in the lower edge 124 of the tile 126 being securely seated within the hook portion 40 as shown in solid lines in FIG. 7. In this position, the spring arm 54 cannot return to its at rest or unbiased position but rather is held in an intermediate biased position against the upper edge 132 of the tile, such as at a position 78 shown in FIG. 1. The deflection of the free end tile engagement portion 60 of the spring arm 54 against the upper edge 132 of a tile in its installed position is shown by the distance 146 in FIG. 8.

With a tile 126 seated within the hook portion 40 of a fastener 10, the spring arm 54 presses downwardly on the top edge 132 of the tile 126 thereby holding or locking it within the open mouth 48 of the hook portion 40 with a resilient spring generated force represented by force arrows 144 in FIG. 8. Additional tiles are installed over the drip edge 108 along a first tile row in a similar fashion, as further shown in FIGS. 8 and 9.

It should be noted that the opposed side edges 150 of a pair of adjacent juxtaposed tiles overlap a pair of first and second wing portions 24, 32 on an underlying interposed fastener 10 so as to anchor the fastener 10 in place under the weight of two tiles 126. This assists in holding the hook portion 40 in place and thereby anchors the lower edge of an overlying tile within the hook portion 40 and provides superior resistance to deformation of the fastener 10 under high wind conditions.

As seen in phantom in FIG. 9, once the first or bottom row of tiles is installed as described above, a second tile installation assembly 100 is aligned over the top portion of the first row of tiles 126. The bottom edge 154 of the roofing material 84 overlaps the top portion of the fasteners 10 and can either seat against the hook portion 40 within its mouth 48 or, as shown, extend laterally above the hook portion 40 by about a half inch up to several inches. Roofing nails 116 secure the second tile installation assembly 100 in a parallel relationship with and over the first tile installation assembly 100.

The second tile installation assembly 100 is staggered or offset from the first tile installation assembly 100 so that the fasteners 10 on the second tile installation assembly are aligned over the centers of the tiles 126 in the first or lower tile row and thereby are positioned midway between the fasteners 10 and the side edges 150 of the tiles 126 in the first or bottom row of tiles. Tiles 126 are then manually installed on the second or upper tile installation assembly as described above.

Once the second row of tiles is installed, it can be seen that the first row of tiles is effectively held down or locked in place by the combined effects of the second row of tiles held securely in the hook portions 40 of fasteners 10 and the spring arms 54 of fasteners 10. That is, each tile in the first row is clamped and sandwiched between a pair of underlying wing portions 24, 32 on an underlying fastener 10 and by a pair of adjacent overlying tiles on the second row.

The resilient spring arm 54 prevents the tiles on the first row from sliding upwards beneath the tiles on the second row so as to anchor each tile in position and hold each tile in place even in the event of extremely high winds. The first row of tiles is further secured by hooks 120 and subsequent upper tile rows are further secured in hook portions 40 along their bottom edges.

Once the second row of tiles is installed, additional rows of tiles are installed in a symmetrical or similar offset or staggered overlapping relationship. For example, the fasteners 10 on a third row of tiles are aligned directly above the fasteners 10 on the first row of tiles to provide a pleasing symmetrical staggered tile pattern.

Figure 13:
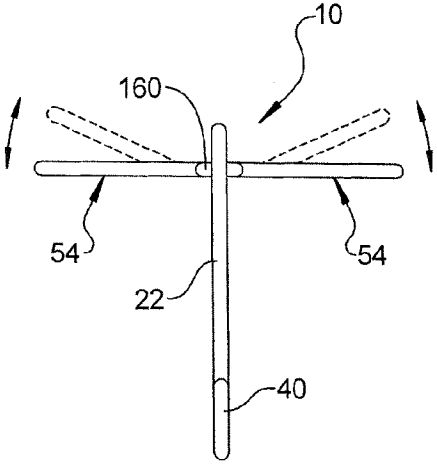
FIG. 13 is an alternate embodiment of the fastener of FIG. 1 with a two piece construction having two laterally extending spring arms.
Figure 12:
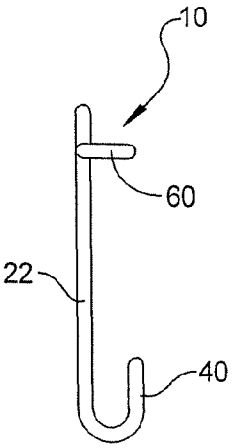
FIG. 12 is a side elevation view of the fastener of FIG. 11.
Figure 11:
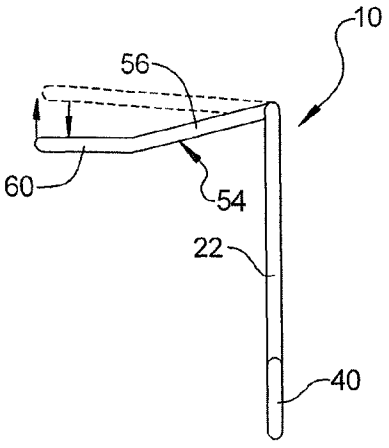
FIG. 11 is a top plan view of an alternate embodiment of the fastener of FIG. 1.

FIGS. 11 and 12 show an alternate embodiment of a fastener 10 suitable for use on a tile installation assembly 100. In this embodiment, the inner portion 56 of the spring arm 54 does not underlie the top portion of a tile 126 as shown in the previous embodiment. Rather, the spring arm 54 extends over and along the top edge of a tile. Another embodiment of a fastener 10 suitable for use on a tile installation assembly 100 is shown in FIG. 13 wherein a fastener 10 is provided with a pair of spring arms 54. In this embodiment, the fastener 10 can be constructed from two separate pieces. A first upper piece forms a shank 22 and a hook 40 and a second lower piece forms a pair of laterally outstretched spring arms 54. The two pieces can be welded or otherwise bonded or fastened together at a fixed joint 160. The hook 10 of FIG. 13 provides a resilient downward spring force to the top edges of a pair of adjacent tiles, thereby providing additional and symmetrical biasing force on each tile.

Figure 14:
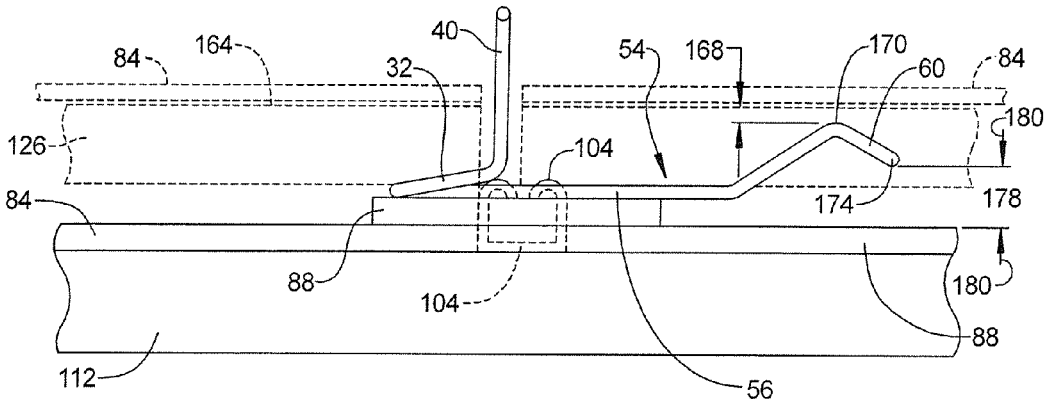
FIG. 14 is an enlarged schematic elevation view in section taken along section line 14-14 of FIG. 9.

As seen in FIG. 14, the height or vertical extension of the free end portion 60 of the spring arm 54 above a roof deck 112 is limited so that it does not extend above the top surface 164 of an abutting tile 126. A recess or clearance 168 is maintained between the uppermost extent or apex 170 of the free end portion 60 of a fastener 10 and the top surface 164 of tile 126. The clearance 168 is for avoiding rubbing or piercing contact between the spring arm 54 and an overlying layer of roofing material 84 on an upper tile roofing installation 100. This prevents wear, tear or damage to the roofing material 84 and thereby maintains the weatherproofing integrity of the overlying roofing material 84.

As further seen in FIG. 14, the tip 174 of the free end tile engaging portion 60 is dimensioned and positioned to establish a clearance 178 above the underlying layer of roofing material 84 and/or the material of the weather shield 88. This clearance 178, as shown between the dimensional arrows 180, ensures that the tip 174 will not rub against or pierce the underlying roofing material 88 or weather shield material. Stated otherwise, the free end tile engagement portion 60 of each fastener 10 which resiliently contacts and abuts a tile 126 does not extend vertically beyond the upper surface or lower surface of the tile. The height of the free end tile engagement portion 60 is preferably less than the thickness of a tile 126 and is maintained in position within that thickness when installed on a roof deck 112.

Figure 15:
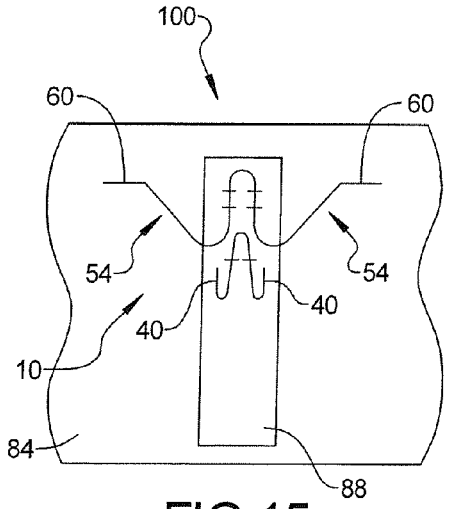
FIG. 15 is a partial top plan view of a two-piece fastener for securing tiles to a roof or other substrate.

Another embodiment of a two piece fastener 10 is shown in FIG. 15. In this example, the spring arms 54 are fastened to the roofing material 84 and weather shield 88 separately from the hook portion 40. With this construction, a pair of hook portions 40 can be provided to secure the lower edge of a the therein. Either a pair of spring arms 54 can be provided on the fastener 10 as shown, or a single spring arm 54 can be provided.

Figure 16:
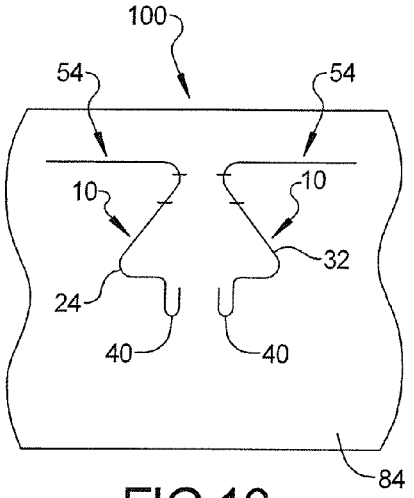
FIG. 16 is a view similar to FIG. 15 showing another embodiment of a fastener that can be used as a single piece or in combination with a second mirror image piece.

As seen in FIG. 16, either one or a pair of side by side separated fasteners 10 is fastened directly to the roofing material 84 without an underlying weather shield 88. It should be noted that while a weather shield 88 provides additional protection to the roofing material 84, particularly along the gaps between the sides of adjacent tiles, in some cases the weather shield 88 is not required and may be eliminated in any of the embodiments disclosed herein under suitable environmental conditions. In the embodiment of FIG. 15, each spring arm 54 is positioned and fixed on the roofing material 84 so that it does not extend beneath an adjacent tile, but rather extends along and above the top edge of an adjacent tile while maintaining a spring biased engagement and abutting contact with the upper edge of the tile.

It will be appreciated by those skilled in the art that the above fasteners and tile installation assemblies are representative of the many possible embodiments of the invention and that the scope of the invention should not be limited thereto, but instead should only be limited according to the following claims.

What is claimed is:

1. A tile installation assembly, comprising:

a sheet of roofing material; and a plurality of fasteners coupled to said roofing material for receiving and holding a series of tiles on a roof, wherein each of said plurality of fasteners comprises an upper portion, a laterally extending cantilevered spring arm having a free end tile engagement portion spaced laterally from said upper portion and a lower portion having a holding portion for holding a tile on a roof, said free end tile engagement portion resiliently flexing freely upwardly away from said lower portion and providing a spring-biased force downwardly toward said lower portion upon said flexing and wherein said free end tile engagement portion provides a downward biasing force against a top portion of an adjacent tile and allowing removal of tiles from a roof without removal of said fasteners from said sheet of roofing material.

2. The tile installation assembly of claim 1, further comprising a plurality of weather shields each having a portion disposed between said sheet of roofing material and said plurality of fasteners.

3. The tile installation assembly of claim 2, wherein said plurality of fasteners is respectively permanently coupled to said sheet of roofing material and to said plurality of weather shields with a plurality of staples.

4. The tile installation assembly of claim 2, wherein said plurality of fasteners comprises a plurality of evenly spaced apart fasteners.

5. The tile installation assembly of claim 1, wherein said free end tile engagement portion projects vertically away from said sheet of roofing material.

6. A tile roof, comprising:

a roof deck;

a first sheet of roofing material overlying a first portion of said roof deck;

a first series of tiles overlying at least a portion of said first sheet of roofing material, each one of said first series of tiles comprising a top edge and a bottom edge; and a first series of fasteners provided between adjacent pairs of said first series of tiles, each of said first series of fasteners comprising a spring arm having a resiliently upwardly deflected portion contacting a top edge portion of an adjacent one of said first series of tiles, said spring arm applying a spring biased downward retaining force on said top edge portion and resiliently opposing upward movement of said adjacent one of said first series of tiles, and allowing removal of said adjacent one of said first series of tiles with an upward push adjacent said bottom edge.

7. The tile roof of claim 6, further comprising a weather shield provided between said sheet of roofing material and an adjacent pair of tiles in said first series of tiles.

8. The tile roof of claim 7 further comprising a second sheet of roofing material overlying a second portion of said roof deck and overlying an upper portion of said first series of tiles, and a second series of tiles overlying at least a portion of said second sheet of roofing material and overlying a top portion of said first series of tiles.

9. The tile roof of claim 8, wherein each of said second series of tiles comprises a top edge and a bottom edge and wherein said bottom edge of at least one tile in said second series of tiles is held by one of said fasteners in said first series of fasteners.

10. The tile roof of claim 9, further comprising a second series of fasteners coupled to said second sheet of roofing material, and wherein at least one fastener in said second series of fasteners pushes one of said tiles in said second series of tiles into engagement with one of said fasteners in said first series of fasteners.

11. The tile roof of claim 6, further comprising a first series of weather shields fixed in place to said first sheet of roofing material and wherein said first series of fasteners is respectively fixed in place to said first series of weather shields so as to form an integral prefabricated roofing assembly.

12. The tile roof of claim 6, wherein each fastener in said first series of fasteners comprises an anchor portion disposed below said spring arm and extending laterally under a pair of adjacent tiles in said first series of tiles.

13. The tile roof of claim 6, wherein said spring arm comprises a laterally extending cantilevered spring arm biased downwardly against said top edge portion.

14. The tile roof of claim 6, wherein said spring arm comprises an end portion extending upwardly away from said roof deck and having a height less than the thickness of said adjacent tile.

15. A tile roof, comprising:

a roof deck;

a first series of tiles provided on said roof deck;

a second series of tiles provided on said roof deck above said first series of tiles;

a first series of fasteners each having a tile holding portion extending vertically above and between adjacent tiles in said first series of tiles;

a second series of fasteners each having a spring arm resiliently pushing down on a respective tile in said second series of tiles and pushing each respective tile in said second series of tiles downwardly against a respective tile holding portion of a fastener in said first series of fasteners; and said spring arm resiliently deflecting upwardly allowing manual removal of each tile in said first series of tiles from said first tile holding portion and from said roof deck.

16. The tile roof of claim 15, wherein each fastener in said second series of fasteners further comprises an anchor portion extending laterally below said spring arm and underneath a pair of adjacent tiles in said first series of tiles.

17. The tile roof of claim 15, further comprising a sheet of roofing material provided under said first and second series of tiles, and wherein said first and second series of fasteners are permanently fixed to said sheet of roofing material.

18. The tile roof of claim 15, further comprising a weather strip fixed in position over said sheet of roofing material and between and under an adjacent pair of tiles in said first and second series of tiles.

19. The tile roof of claim 15, wherein said tile holding portion comprises a hook portion having an open mouth receiving a bottom edge portion of a tile in said second series of tiles.

20. The tile roof of claim 15, wherein said spring arm comprises a freely flexing cantilevered end portion pushing resiliently down on an upper edge portion of a tile in said first series of tiles.

* * * * *